US009099811B2

(12) United States Patent
Simmel et al.

(10) Patent No.: US 9,099,811 B2
(45) Date of Patent: Aug. 4, 2015

(54) SELF-REGISTERED CONNECTORS FOR DEVICES HAVING A CURVED SURFACE

(71) Applicant: Apple Inc., Cupertino, CA (US)

(72) Inventors: George Marc Simmel, Cupertino, CA (US); Chia Chi Wu, Taipei (TW); Daniel A. Bergvall, San Jose, CA (US)

(73) Assignee: Apple Inc., Cupertino, CA (US)

( * ) Notice: Subject to any disclaimer, the term of this patent is extended or adjusted under 35 U.S.C. 154(b) by 146 days.

(21) Appl. No.: 13/913,194

(22) Filed: Jun. 7, 2013

(65) Prior Publication Data

US 2014/0364008 A1 Dec. 11, 2014

(51) Int. Cl.

| | |
|---|---|
| ***H01R 13/648*** | (2006.01) |
| ***H01R 13/64*** | (2006.01) |
| ***H01R 43/16*** | (2006.01) |
| ***H01R 12/70*** | (2011.01) |
| ***H01R 13/405*** | (2006.01) |
| ***H01R 13/514*** | (2006.01) |
| ***H01R 25/00*** | (2006.01) |
| *H01R 13/74* | (2006.01) |

(52) U.S. Cl.

CPC ..... *H01R 13/64* (2013.01); *H01R 12/7052* (2013.01); *H01R 13/405* (2013.01); *H01R 13/514* (2013.01); *H01R 25/006* (2013.01); *H01R 43/16* (2013.01); *H01R 13/74* (2013.01); *Y10T 29/49208* (2015.01)

(58) Field of Classification Search

USPC ..... 439/607.23, 607.25, 607.35, 607.55, 439/607.56

IPC ..... H01R 23/6873,23/7073, 13/65802, H01R 13/658, 13/6275

See application file for complete search history.

(56) References Cited

U.S. PATENT DOCUMENTS

| | | | | |
|---|---|---|---|---|
| 6,600,865 | B2 * | 7/2003 | Hwang | 385/134 |
| 7,621,780 | B2 * | 11/2009 | Magnusson | 439/607.23 |
| 7,695,314 | B2 * | 4/2010 | Okuyama et al. | 439/541.5 |
| 7,963,799 | B1 * | 6/2011 | Lee et al. | 439/607.23 |
| 8,353,722 | B1 | 1/2013 | Lan et al. | |
| 2010/0267282 | A1 | 10/2010 | Tsai | |

FOREIGN PATENT DOCUMENTS

EP 1 337 010 A2 8/2003

OTHER PUBLICATIONS

International Search Report and Written Opinion of the International Searching Authority mailed on Nov. 4, 2014 for PCT Patent Application No. PCT/US2014/040301, 17 pages.

Invitation to Pay Additional Fees and, Where Applicable, Protest Fee mailed on Aug. 1, 2014 for PCT Patent Application No. PCT/US2014/040301, 7 pages.

* cited by examiner

*Primary Examiner* — Hien Vu

(74) *Attorney, Agent, or Firm* — Kilpatrick Townsend & Stockton LLP

(57) ABSTRACT

Connector receptacles may be provided, where a multiple of such connector receptacles may be readily aligned to openings in a device enclosure, particularly where the openings are located on a curved or otherwise non-planar surface of the device enclosure. One example may provide a connector assembly that includes a plurality of connector receptacles. The connector receptacles in a connector assembly may be accurately aligned or registered to each other, and the connector assembly may be accurately aligned to a device enclosure. In this way, several connector receptacles may be accurately aligned to openings in the device enclosure. In another example, two or more connector receptacles may have faces that are at an oblique angle relative to each other.

16 Claims, 20 Drawing Sheets

SELF-REGISTERED CONNECTORS FOR DEVICES HAVING A CURVED SURFACE

BACKGROUND

Portable electronic devices, such as portable media players, tablet, netbook, and laptop computers, and cell, media, and smart phones, have become ubiquitous in recent years. These devices may communicate with each other using cables having connector inserts on each end, where the connector inserts are inserted into connector receptacles on the communicating devices.

Conventionally, each device may communicate with a particular device using a specific type of receptacle and cable. For example, a computer may communicate with a display using a Digital Video Interface (DVI) connector and cable and a hard drive using a Universal Serial Bus (USB) connector and cable. Apple Inc., of Cupertino, Calif., has reduced this complexity by developing the Thunderbolt interface, which can be used to communicate with displays, hard drives, and other devices.

This increased usefulness has increased the need for multiple Thunderbolt connector receptacles on a single device. But placing a number of connectors of any type on a device comes with its own difficulties. For example, a number of connectors may have a number of pins or contacts that may terminate in corresponding holes in a printed circuit board. It may be difficult to align a large number of pins with their corresponding holes. It may also be desirable to align each connector receptacle to an opening in a housing for the electronic device. While an individual connector receptacle may be aligned to an opening in such a housing, aligning several such connector receptacles to several openings may be a more difficult proposition. This task may be further exacerbated if the device openings themselves are located on a curved or otherwise non-planar surface of the device enclosure.

Thus, what is needed are connector receptacles where a multiple of such connector receptacles may be readily aligned to holes in a printed circuit board and openings in an enclosure for an electronic device, particularly where the openings are located on a curved or otherwise non-planar surface of the device enclosure.

SUMMARY

Accordingly, embodiments of the present invention may provide connector receptacles where a multiple of such connector receptacles may be readily aligned to holes in a printed circuit board and to openings in a device enclosure, particularly where the openings are located on a curved or otherwise non-planar surface of the device enclosure.

An illustrative embodiment of the present invention may provide connector receptacle assemblies where pins for multiple connector receptacles may be readily aligned to printed circuit board openings and where the connector receptacles themselves may be aligned to openings in a device enclosure. The connector receptacles in a connector assembly may be accurately aligned or registered to each other. The connector assembly may then be accurately aligned to a device enclosure. In this way, pins in the connector assembly may be aligned to openings in a printed circuit board, while the several connector receptacles may be accurately aligned to openings in the device enclosure.

The connector assembly may include a number of modules, for example, two, three, four, or more modules. Each module may include a number of connector receptacles, for example, two, three, four, or more connector receptacles. The connector receptacles in a module may be accurately aligned and registered to each other by using a main insert mold including a registration piece to join two or more connector receptacles. The main insert mold may form at least a part of a base on which a plurality of connector receptacles may be located. By locating multiple connector receptacles on one main insert mold, the alignment and registration between the connector receptacles in a module may be well controlled.

The modules in a connector assembly according to an embodiment of the present invention may be aligned and registered in a first and second direction by using one or more alignment pins that may pass through a registration piece in each module. For example, a connector assembly may include one, two, three, or more than three such alignment pins.

The registration pieces may include features that may contact corresponding features on other registration pieces in order to register the modules in the remaining third direction. In a specific embodiment of the present invention, each registration piece may have a standoff on each of two sides, such that standoffs on adjacent registration pieces in adjacent modules may contact each other, thereby fixing their positions in the third direction relative to each other. In another specific embodiment of the present invention, the alignment pins may be located in passages in each registration piece. The passages may form openings in a top and bottom of the registration pieces. The passages may have raised lips around their openings. The lips of one registration piece may contact the lips around a passage on a registration piece in another module, thereby fixing the relative position of the two modules in the third direction. Additional registration features, such as alignment bumps on shield portions, may also be included.

Another embodiment of the present invention may secure these modules to each other. In a specific embodiment of the present invention, a connector assembly may include two or more modules. These modules may be arranged as two outside modules, and zero, one, two, or more than two inside modules may be placed between the two outside modules. The modules may be individually or collectively shielded, such that outside edges of the connector assembly are shielded. A shield portion may be attached to the outside shielded edges to secure the various modules relative to each other. This shield portion may be in the form of a strap or other appropriate structure.

Another illustrative embodiment of the present invention may align a connector assembly to a device enclosure. An illustrative embodiment of the present invention may provide a connector assembly having an alignment post. The alignment post may have a first end inserted in a registration piece of one of the plurality of modules forming the connector assembly. The alignment post may be secured in place with a shield portion that also secures the modules in place relative to each other. The alignment post may have a second end inserted in an opening in the device enclosure.

Another illustrative embodiment of the present invention may align the connector receptacles to openings in a curved surface of a device enclosure by providing two or more connector receptacles having openings or faces that are at an oblique angle to each other. These oblique angles may be formed in one or more planes.

An illustrative embodiment of the present invention may provide a connector assembly having a number of modules each having a number of connector receptacles. Connector receptacles within a module may be accurately positioned relative to each other by mounting them on a common main insert mold. Connector receptacles among modules may be accurately positioned relative to each other in a first and second direction by using alignment pins that may be inserted through the modules, and in a third direction by registration features, such as lips or standoffs on front and back sides of the main insert mold in each module. In these examples, the third direction may be along the length of an alignment pin and the first and second directions may be orthogonal to the third direction and in a plane between modules. Through-hole contacting portions for pins in these connectors may be accurately positioned relative to each other by forming insert molds around the pins and using alignment features, such as posts, to position the molds and their pins relative to each other within a module. Pins among modules may be positioned relative to each other by the use of alignment pins and registration features, such as lips or standoffs.

While various embodiments of the present invention are particularly well-suited to use in providing a plurality of Thunderbolt connector receptacles, other embodiments of the present invention may provide a plurality of Thunderbolt, MagSafe, DisplayPort, one or more of the various Universal Serial Bus interfaces and standards, including USB, USB2, and USB3, as well as High-Definition Multimedia Interface (HDMI), Digital Visual Interface (DVI), Ethernet, and other types of interfaces and standards, or other connector receptacles, or combinations thereof.

While various embodiments of the present invention are particularly well-suited to use in providing a plurality of connector receptacles for a computer, other embodiments of the present invention may provide a plurality of connector receptacles for other devices, such as portable media players, tablet, netbook, and laptop computers, and cell, media, and smart phones, navigation systems, monitors, and others, may be improved by the inclusion of embodiments of the present invention.

Various portions of connector assemblies provided by embodiments of the present invention may be made using various techniques. For example, insert molds and other portions of connector assemblies consistent with embodiments of the present invention may be formed by insert molding, stamping, lathing, metal insert molding, 3-D printing, by using computer numerical control (CNC) machines, or by other techniques.

Portions of these connector assemblies may be formed of various materials. For example, pins, shields, alignments posts, alignments pins, and other portions of connector assemblies consistent with embodiments of the present invention may be formed of stainless steel, copper, copper titanium, phosphor bronze, nickel, or other appropriate material, and they may be plated with copper, nickel, palladium, gold, or other appropriate material. Other portions of these connector assemblies may be formed of plastic, polymers, rubber, or other conductive or non-conductive material.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
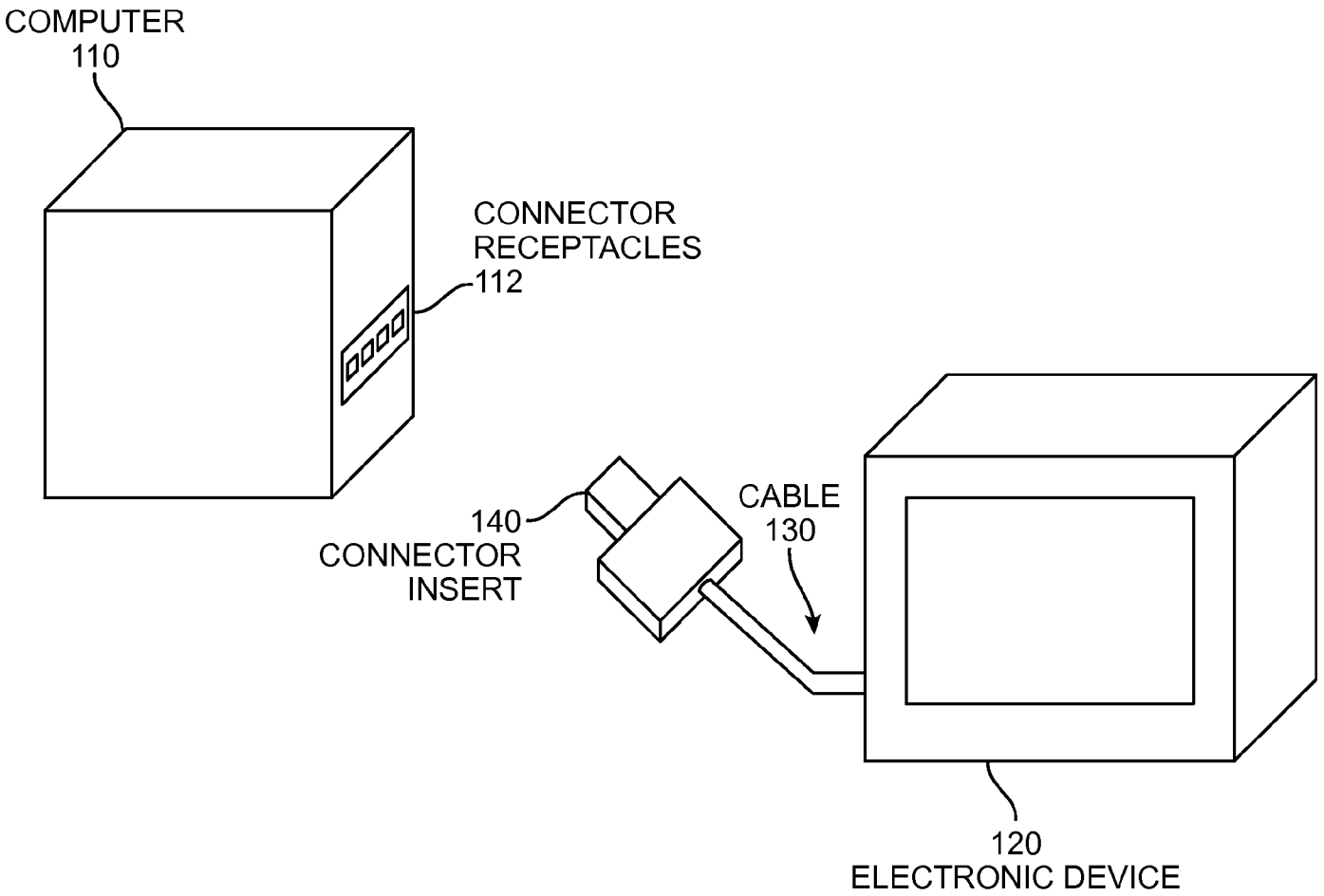
FIG. 1 illustrates an electronic system that may be improved by the incorporation of embodiments of the present invention.

FIG. 1 illustrates an electronic system that may be improved by the incorporation of embodiments of the present invention. This figure, as with the other included figures, is shown for illustrative purposes and does not limit either the possible embodiments of the present invention or the claims.

FIG. 1 includes computer 110 and electronic device 120. Computer 110 may communicate with electronic device 120 through cable 130. Specifically, connector insert 140 may be inserted into one of the group of connector receptacles 112 on computer 110, and computer 110 may communicate with an electronic device 120 by sending and receiving signals (and perhaps power), through conductors in cable 130.

Again, it may be desirable for computer 110 to communicate with several devices. These devices may be able to communicate with computer 110 using the same interface standard. Accordingly, several connector receptacles of the same type may be provided as a unit or group of connector receptacle 112, which may be referred to as a connector assembly. Connector assembly 112 may include a number of connector receptacles, each having a number of contacts or pins, which may terminate in through-hole portions that are soldered to traces connected to openings in a printed circuit board.

Unfortunately, when several connector receptacles are provided as a unit, it may be very difficult to align through-hole portions for all the necessary pins of the receptacles to openings in a printed circuit board. It may also be difficult to align the connector receptacle openings to corresponding openings in a device enclosure of computer 110. This is particularly true if a surface of the enclosure for computer 110 is curved at these openings.

Accordingly, embodiments of the present invention may provide connector assemblies where a number of connector receptacles are accurately aligned and registered to each other. Moreover, through-hole contacting portions for pins or contacts in a number of connector receptacles may also be accurately aligned and registered to each other. An example of one such connector assembly is shown in the following figure.

Figure 2:
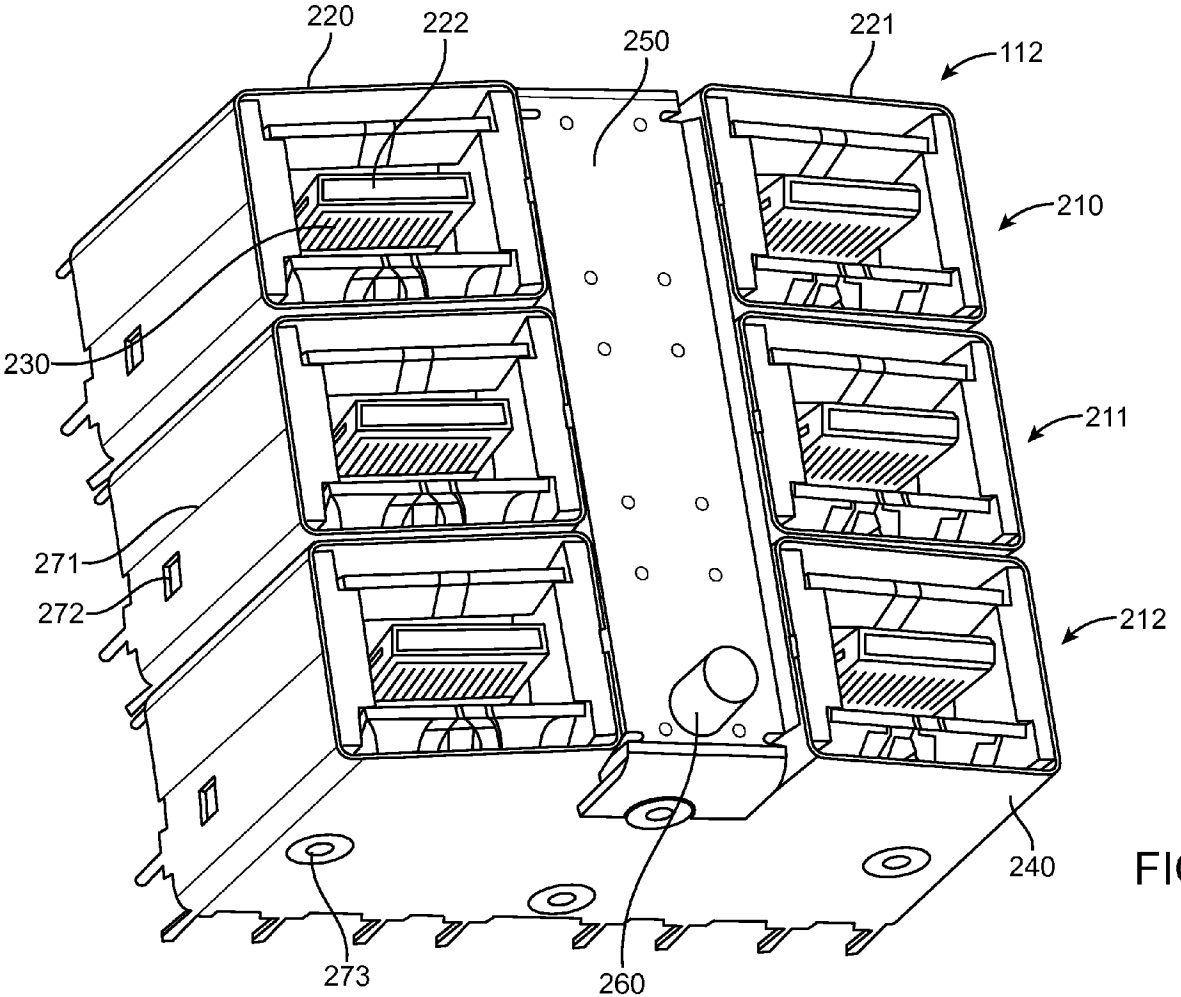
FIG. 2 illustrates a connector assembly according to an embodiment of the present invention.

FIG. 2 illustrates a connector assembly according to an embodiment of the present invention. Connector assembly 112 may include a number of modules, each including a number of receptacles. In this example, connector assembly 112 may include three models, modules 210, 211, and 212. Each of these modules may include two connector receptacles. For example, module 210 may include connector receptacles 220 and 221. These connector receptacles may include tongue 222 supporting a number of contacts 230.

A shield 240 may surround each module 210. Shield portion 250 may attach to a top of modules 210 and a bottom of module 212 to secure modules 210, 211, and 212 together. Alignment post 260 may be inserted into a corresponding opening in a device enclosure to align connector assembly 112 to openings in the device enclosure.

In this example, shield 240 may be formed around each module in a way that creates seam 271. In other embodiments of the present invention, seam 271 may be hidden from view. For example, it may be located on a surface of shield 240 that is located between adjacent modules. Tabs 272 may be used to secure shield 240 relative to an internal housing. In other embodiments of the present invention, tabs 272 may be omitted for cosmetic reasons.

Similarly, registration bumps 273 may be included to help determine the spacing among modules 210, 211, and 212. For example, registration bumps 273 may be located on a bottom of modules 210, 211, and 212. A registration bump 273 may encounter a flat surface of a shield 240. Registration bumps 273 may be included on each module such that each module may be formed in an identical manner. In other embodiments of the present invention, registration bumps 273 may be omitted from a bottom module 212 for cosmetic reasons. In this way, each registration bump 273 is located and in contact with a surface between two of the modules 210, 211, and 212.

Figure 3:
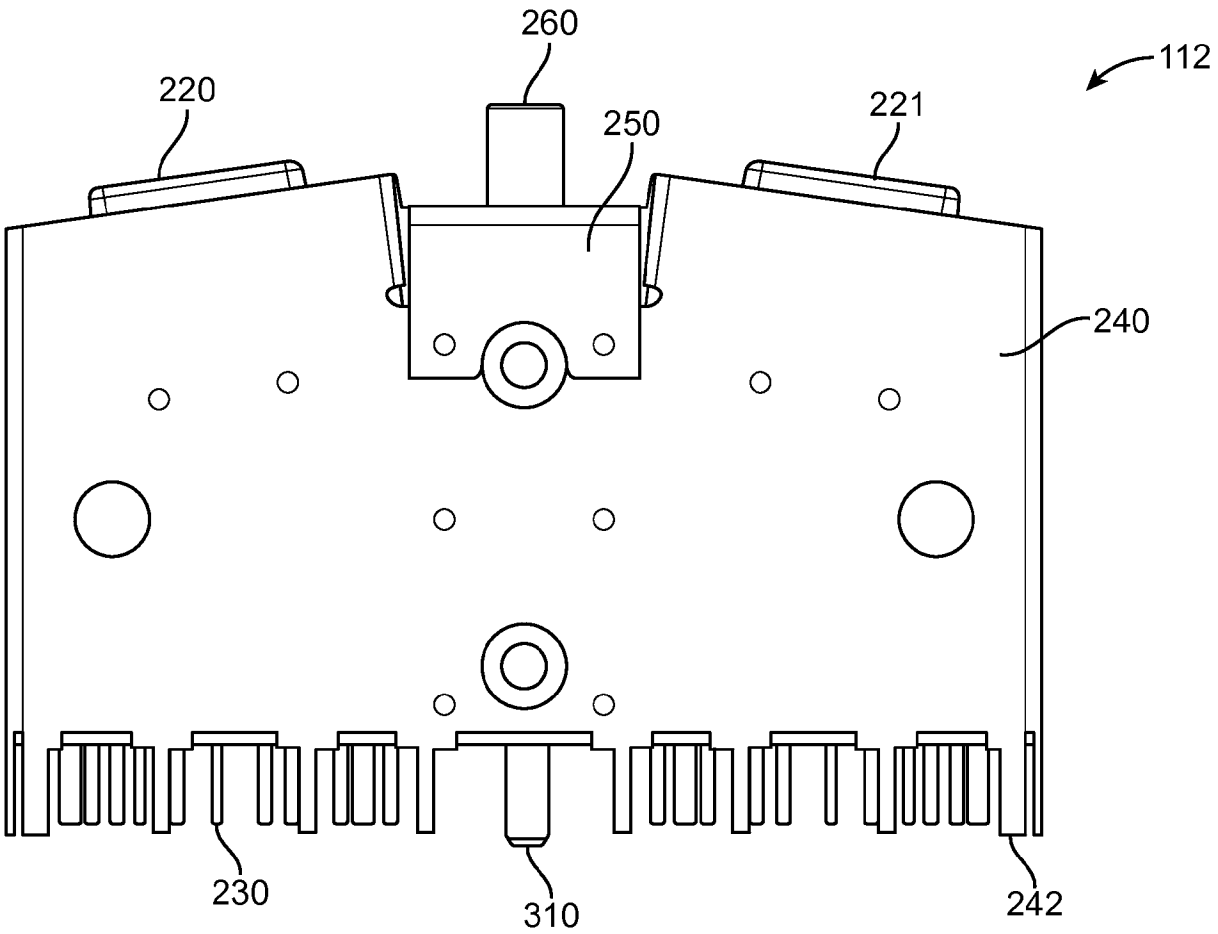
FIG. 3 illustrates a bottom view of a connector assembly according to an embodiment of the present invention.

FIG. 3 illustrates a bottom view of a connector assembly according to an embodiment of the present invention. Again, connector assembly 112 may include two connector receptacles 220 and 221. A shield 240 may surround each module. Strap or shield portion 250 may be used to secure the models in a connector assembly to each other. Alignment post 260 may be included to align connector assembly 112 to openings in a device enclosure. Post 310 may be used to align pins 230 and shield tabs 242 to openings in a printed circuit board, and to provide mechanical stability for connector assembly 112 on the printed circuit board.

Again, embodiments of the present invention are well-suited for use in devices where a device enclosure housing includes a curved surface. Accordingly, connector receptacle 220 and connector receptacle 221 may have faces that are at an oblique angle to each other in at least one plane. In other embodiments of the present invention, connector receptacle 220 and 221 may have faces that are parallel to each other, or their faces may be oblique or orthogonal to each other in one or more different planes.

Figure 4:
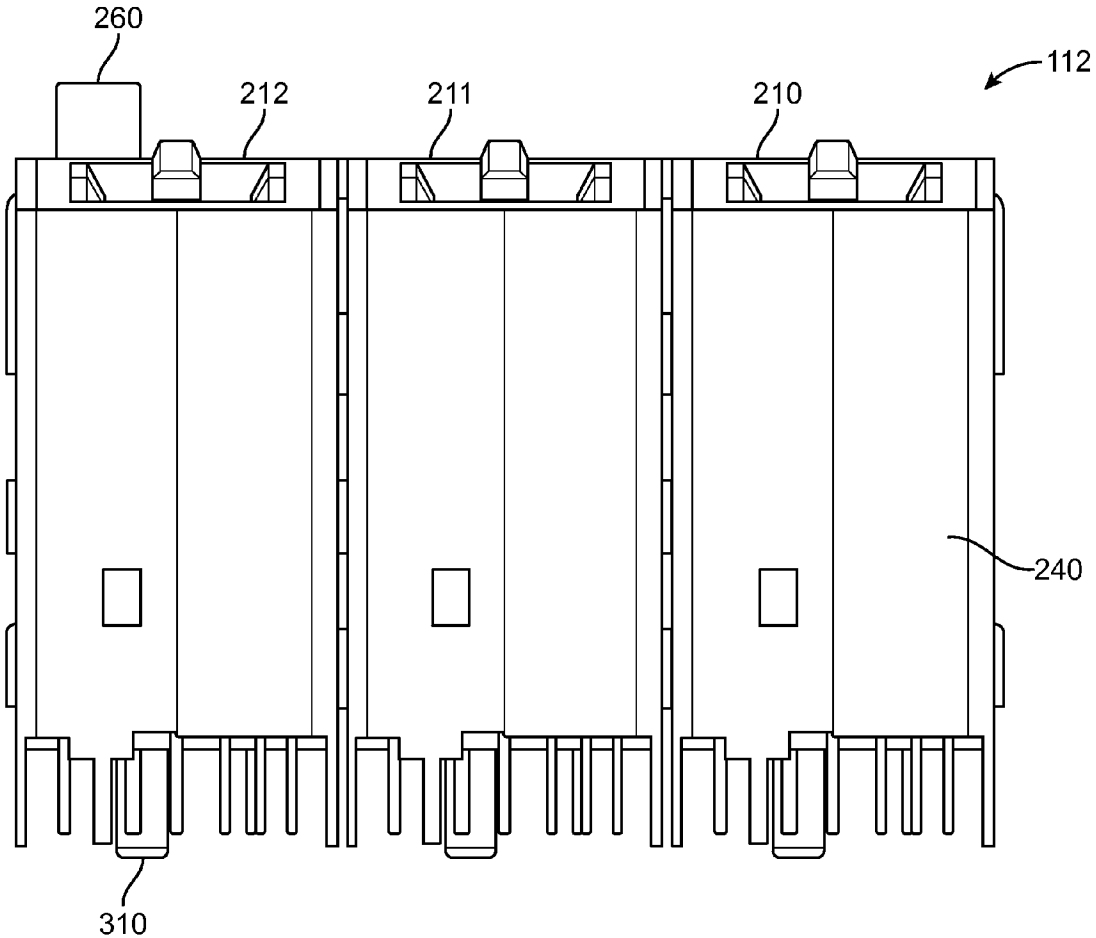
FIG. 4 illustrates a side view of a connector assembly according to an embodiment of the present invention.

FIG. 4 illustrates a side view of a connector assembly according to an embodiment of the present invention. Again, connector assembly 112 may include multiple modules, for example modules 210, 211, and 212. Alignment post 260 may be used to align connector assembly 112 to openings in a device enclosure. Posts 310 may be used to align connector through-hole portions of pins or contacts of connector assembly 112 to openings in a printed circuit board. Each module 210, 211, and 212 may be at least partially surrounded by a shield 240.

Figure 5:
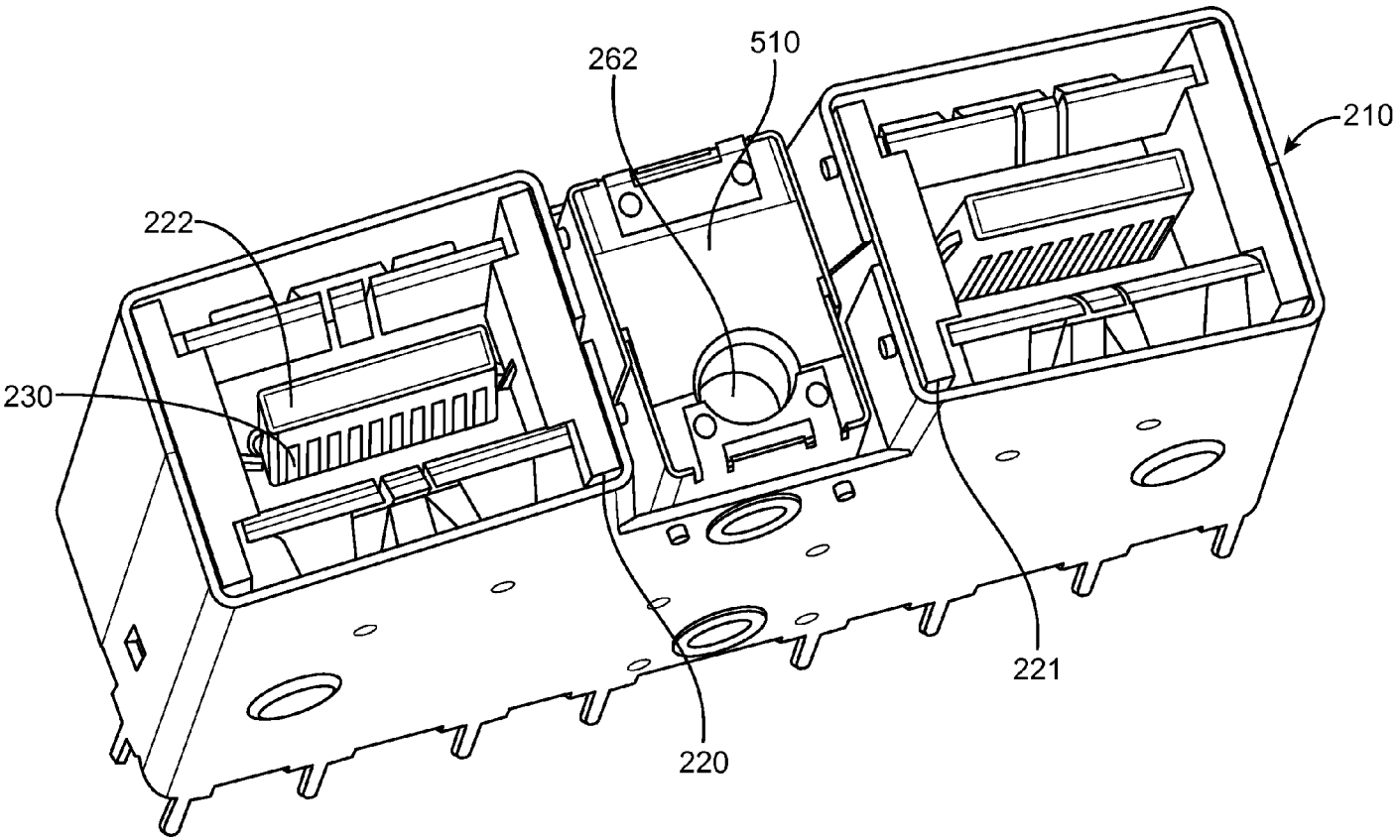
FIG. 5 illustrates a module for use in a connector assembly according to an embodiment of the present invention.

FIG. 5 illustrates a module for use in a connector assembly according to an embodiment of the present invention. As before, module 210 may include connector receptacles 220 and 221. Each connector receptacle 220 and 221 may include tongue 222 supporting a number of contacts or pins 230. Registration piece 510 may be located between connector receptacles 220 and 221. Registration piece 510 may include a hole 262, into which alignment post 260 may be inserted.

Figure 6:
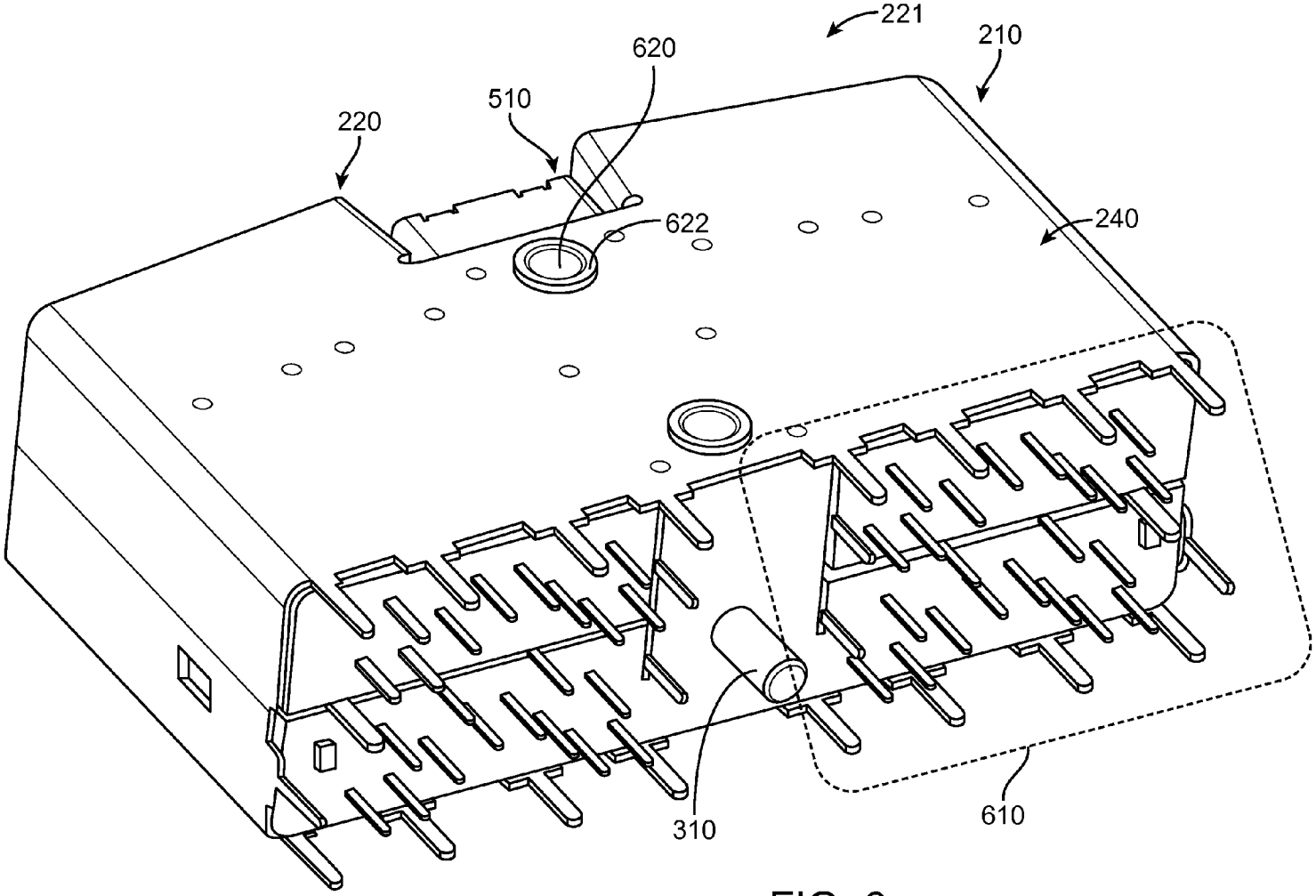
FIG. 6 illustrates a back side of a module for a connector assembly according to an embodiment of the present invention.

FIG. 6 illustrates a back side of a module for a connector assembly according to an embodiment of the present invention. Again, module 210 may include connector receptacles 220 and 221. Registration piece 510 may be located between connector receptacles 220 and 221. Registration piece 510 may further include post 310, which may be inserted into a corresponding opening in a printed circuit board.

Registration piece 510 may further include passages 620, which may be used for alignment pins, as shown below. Registration piece 510 may include one or more other registration or alignment features. In this example, passage 620 may include a lip 622. Lip 622 may extend above shield 240. Lip 622 on adjoining modules may be in contact with each other, thereby accurately registering the position of the modules to each other.

As can be seen, each connector receptacle may have a large number of corresponding through-hole contacting portions and ground tabs forming array 610. This large number of through-hole contacting portions and ground tabs may be difficult to align to corresponding openings and holes in a printed circuit board. By accurately registering connector receptacles in a connector assembly, connector assemblies according to an embodiment of the present invention may provide through-hole arrays 610 that may be reliably inserted into holes or openings on a printed circuit board.

Figure 7:
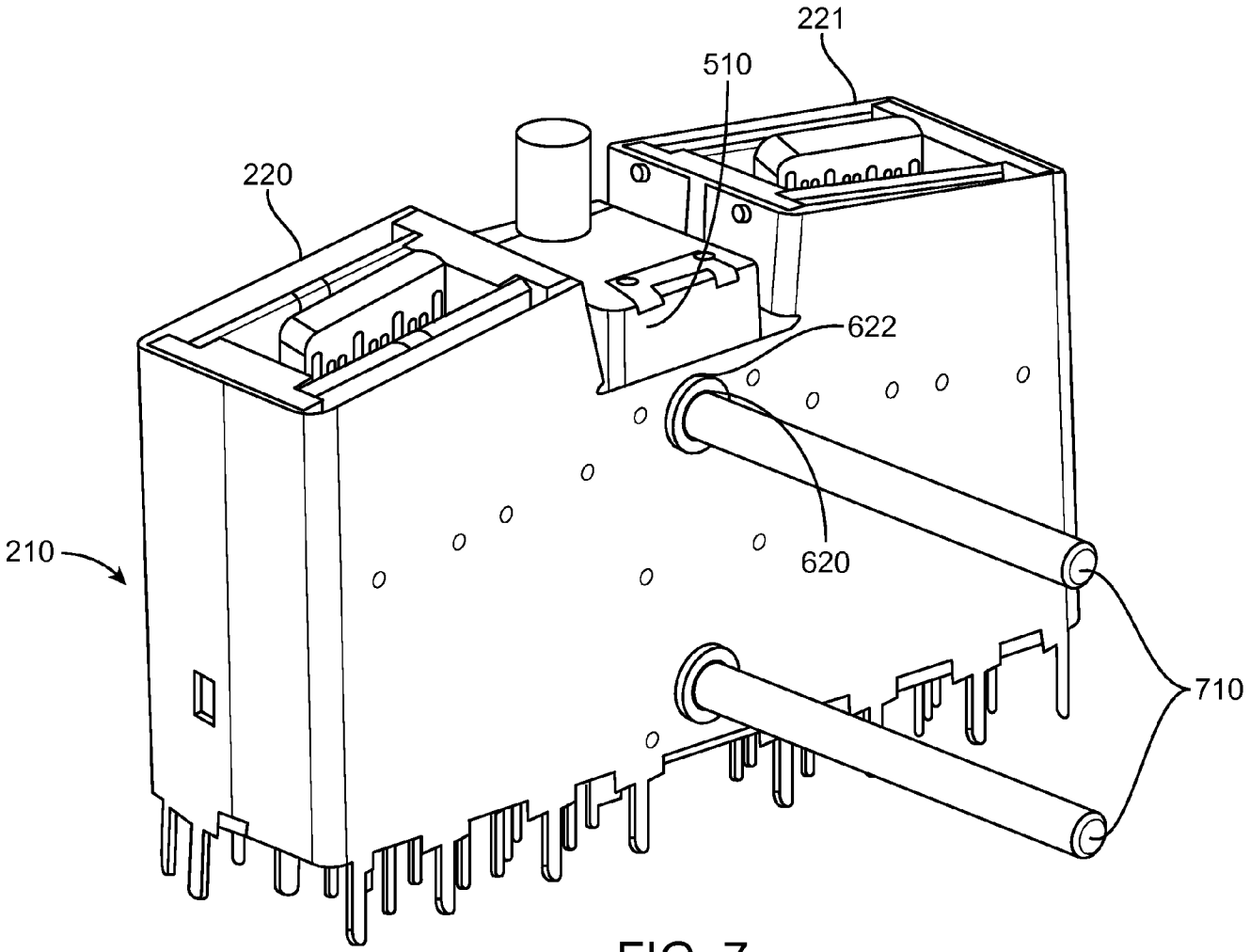
FIG. 7 illustrates alignment pins that may be used to align modules to each other in a connector assembly according to an embodiment of the present invention.

FIG. 7 illustrates alignment pins that may be used to align modules to each other in a connector assembly according to an embodiment of the present invention. As before, module 210 may include connector receptacles 220 and 221. Registration piece 510 may be located between connector receptacles 220 and 221. Registration piece 510 may include passages 620, into which alignment pins 710 may be inserted. Using alignment pins at 710 may fix or align modules 210 to each other in a first and second direction. Having lips 622 in contact with each other between modules registers the position of the modules 210, 211, and 212 in the third direction.

Figure 8:
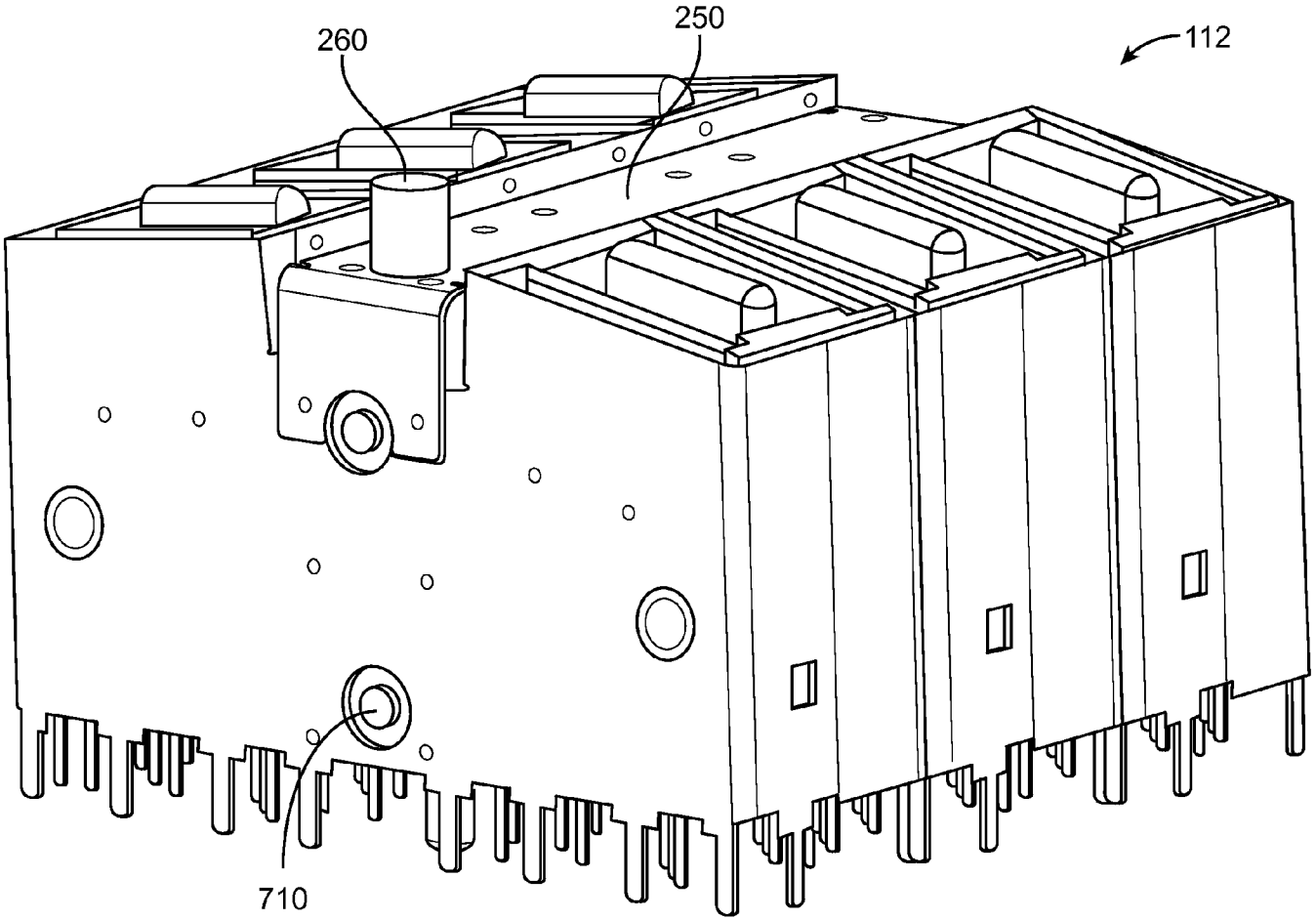
FIG. 8 illustrates an assembled connector assembly according to an embodiment of the present invention.

FIG. 8 illustrates an assembled connector assembly according to an embodiment of the present invention. Again, the models in connector assembly 112 may be strapped together using shield portion or strap 250. Shield portion or strap 250 may also help align each of the modules in connector assembly 112 to each other. Alignment post 260 may be included. Alignment pins 710 may be inserted through registration pieces in each of the models in connector assembly 112.

During assembly, when the modules of connector assembly 112 are joined together, they may initially be overstressed in a direction that compresses the modules together. This force may then be relaxed, and strap 250 may be attached to align and fix the positions of the modules together. By relaxing the force on the modules, connector assembly 112 may have a reduced change due to settling of the completed assembly after manufacturing.

Again, each module may include one or more registration features for accurately registering the modules to each other. In the above examples, lips 622 provided this feature. In another embodiment of the present invention, a standoff or other feature may be used. This feature may be located near a base of the registration piece to more accurately position through-hole contacting portions for insertion into holes in a printed circuit board. An example is show in the following figure.

Figure 9:
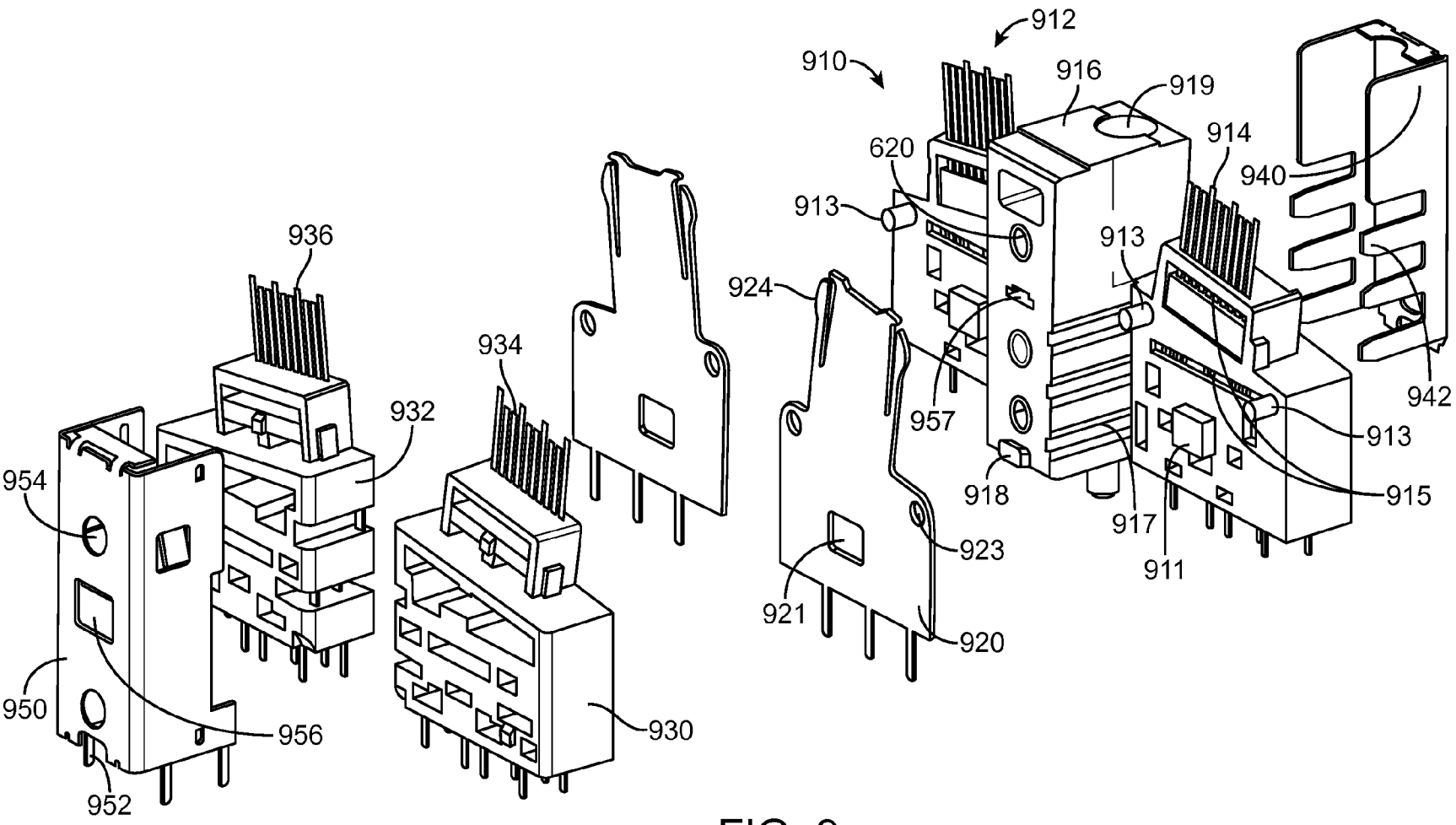
FIG. 9 illustrates various components of a module for a connector assembly according to an embodiment of the present invention.

FIG. 9 illustrates various components of a module for a connector assembly according to an embodiment of the present invention. Main insert mold 910 may be formed around pins 912 and 914. Openings 915 may be used to secure pins 912 and 914 in place while insert mold 910 is formed. Insert mold 910 may include registration piece 916. Registration piece 916 may include an opening 919 for an alignment post and passages 620 for alignment pins.

Again, in various embodiments of the present invention, one or more registration features may be used to align modules to each other. In this example, registration piece 916 may include standoff 918. Standoff 918 may come in contact with a corresponding standoff on a back of registration piece 916 in another module. In this way, the registration between modules of a connector assembly according to an embodiment of the present invention may be dictated by the size of main insert mold 910. This size may be well-controlled, thereby providing connector assemblies having accurate alignment and spacing.

Ground planes 920 may be attached to right and left sides of a back of main insert mold 910. Specifically, openings 923 in ground planes 920 may fit over posts 913 on main insert mold 910, while opening 921 may align with feature 911. Side tabs 924 may be side ground contacts on a tongue in a connector receptacle.

Second insert mold 930 and third insert mold 932 may be formed around pins 934 and 936. Insert molds 930 and 932 may include openings for receiving posts 913 and features 911. As before, insert mold portions 930 and 932 may include one or more openings where pins 934 and 936 may be held during formation of the molds.

Shield 940 may be fitted around a portion of registration piece 916. Specifically, tabs 942 may be inserted through slots 917 of registration piece 916 in main insert mold 910. Shield portion 950 may be placed over a front of registration piece 916. Shield 950 may include openings 952 for standoff portion 918 and opening 954 for passage 620. Tab 956 may be located in openings 957 in order to align shield portion 950 to registration piece 916.

Figure 10:
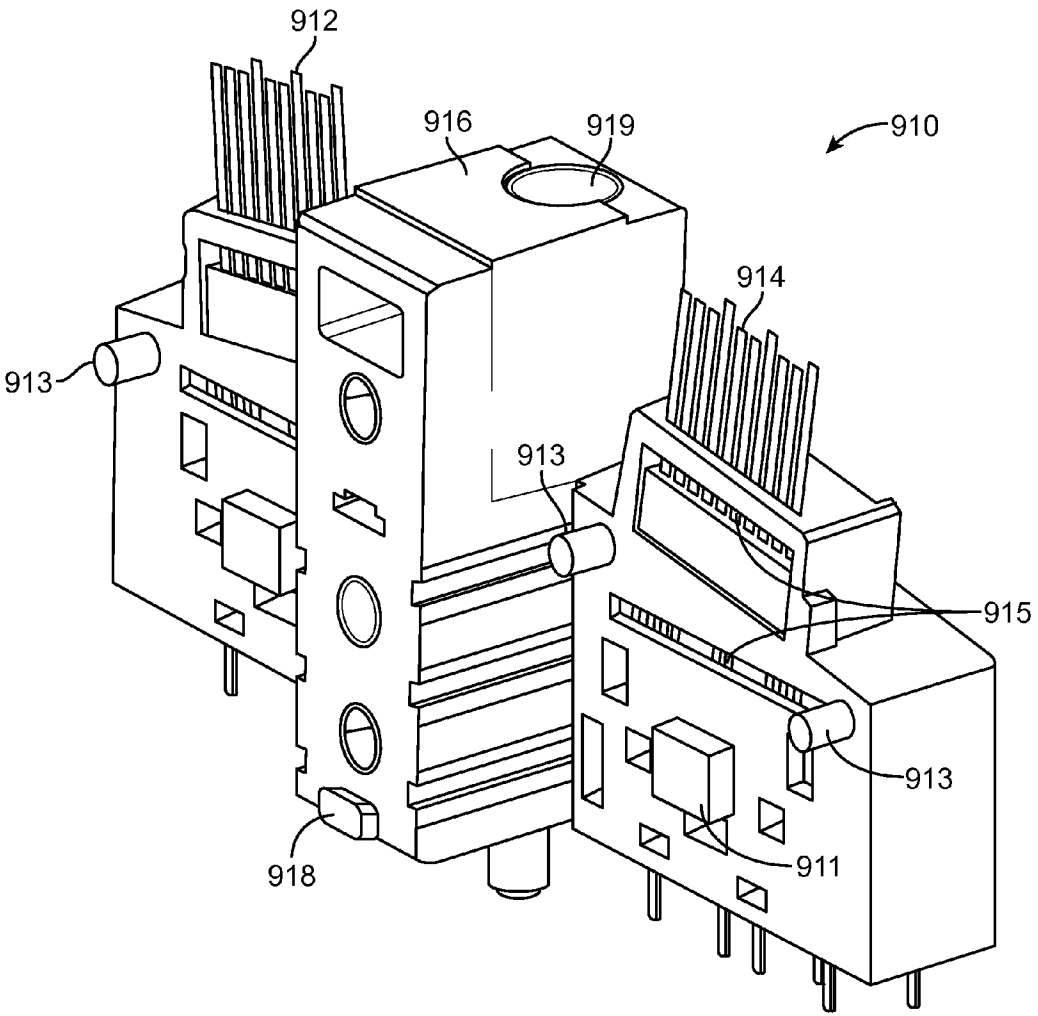
FIG. 10 is a more detailed view of a main insert mold according to an embodiment of the present invention.

FIG. 10 is a more detailed view of a main insert mold according to an embodiment of the present invention. Again, main insert mold 910 may be formed around pins 912 and 914. Openings 915 may be used to secure pins 912 and 914 in place during the formation of insert mold 910. Main insert mold 910 may include posts and features 913 and 911, to which ground planes and further insert molds may be attached. Registration piece 916 may include opening 919 for an alignment post. Registration piece 916 may further include standoff 918. As mentioned above, a back of registration piece 916 may include a second standoff similar to standoff 918. In this way, standoff 918 in adjoining modules may contact each other, thereby accurately determining a registration or spacing between connector receptacles in different modules.

Figure 11:
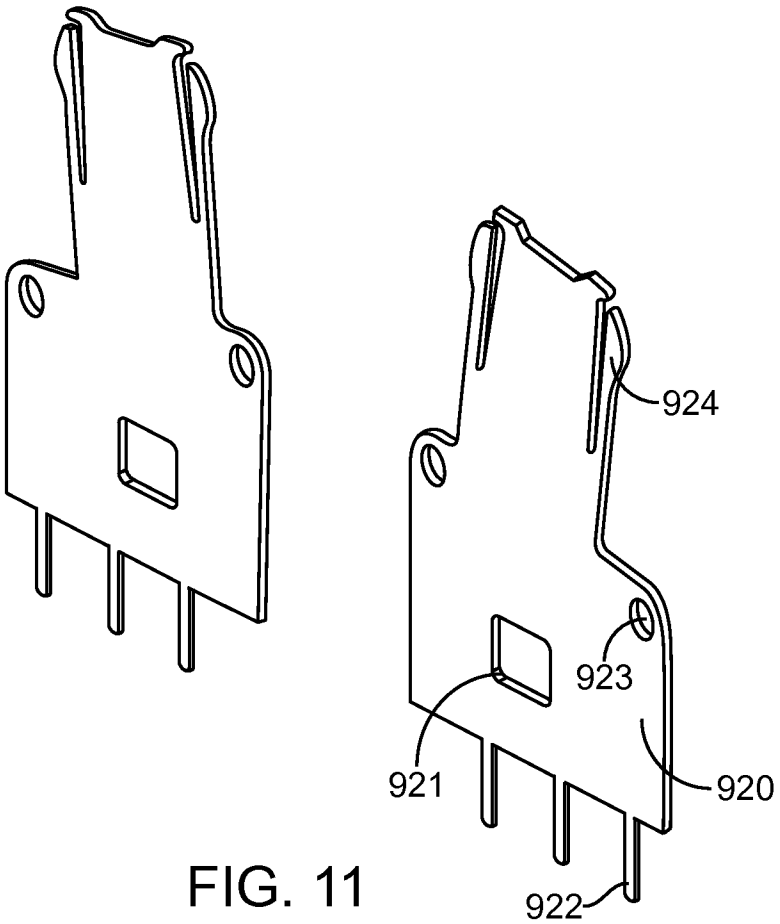
FIG. 11 illustrates ground planes may be used in a module in a connector assembly according to an embodiment of the present invention.

FIG. 11 illustrates ground planes may be used in a module in a connector assembly according to an embodiment of the present invention. Again, side tabs 924 may be used as side ground contacts in a tongue in a connector receptacle in a connector assembly. Openings 923 and 921 may be used to align ground plane 920 to features on a main insert mold. Tabs 922 may be inserted into openings of a printed circuit board. These openings may be connected to traces or a plane connected to ground or other appropriate potential.

Figure 12:
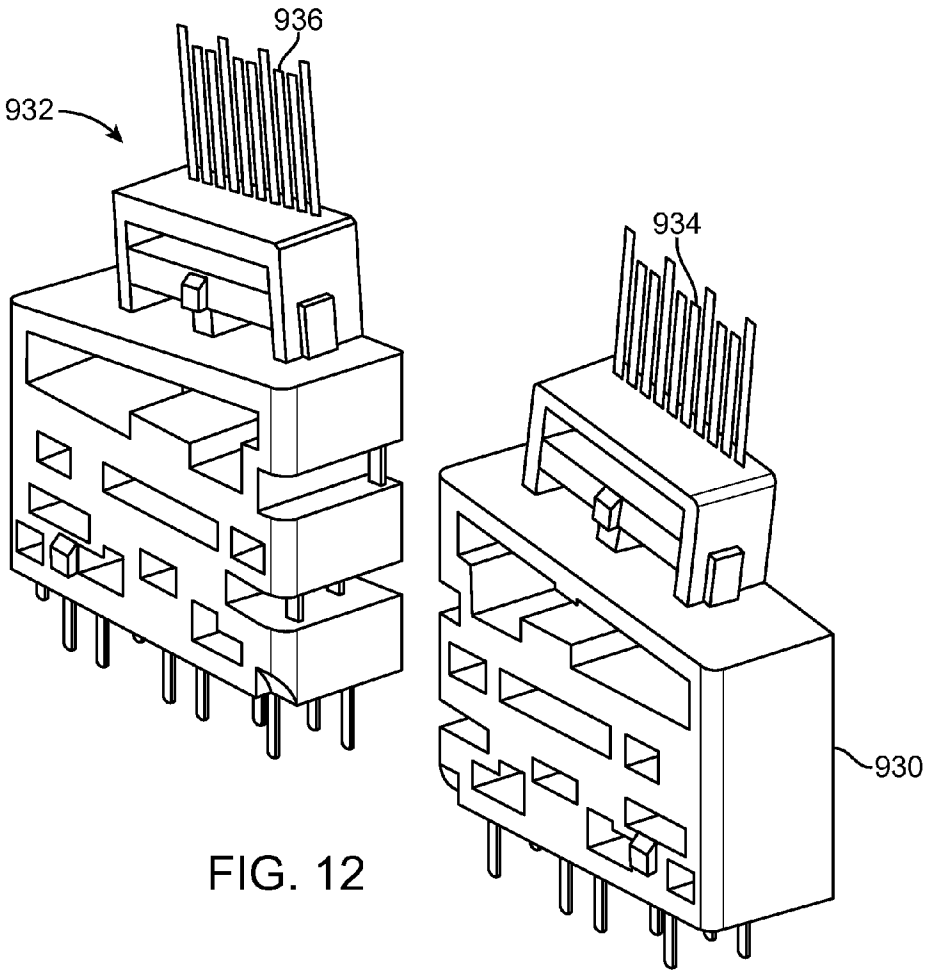
FIG. 12 illustrates a second and third insert mold according to an embodiment of the present invention.

FIG. 12 illustrates a second and third insert mold according to an embodiment of the present invention. Inset molds 930 and 932 may be formed around pins 934 and 936. In various embodiments of the present invention, insert molds 930 and 932 may be mirror-images of each other.

Figure 13:
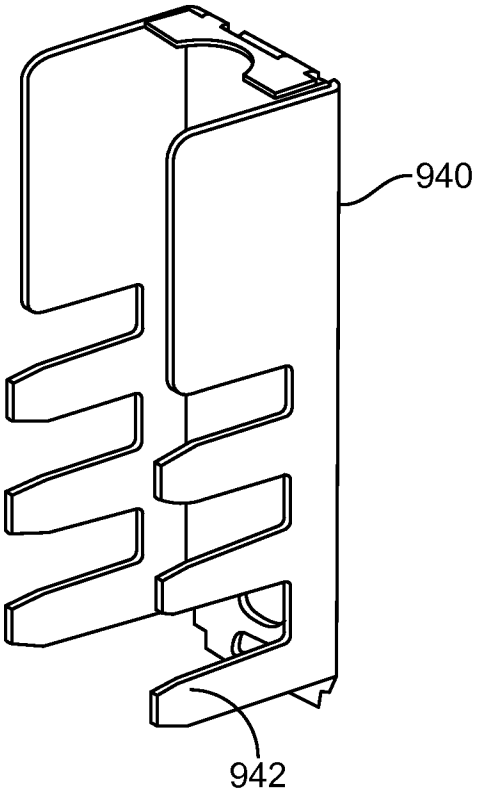
FIG. 13 illustrates a more detailed view of shield portions according to an embodiment of the present invention.
Figure 13:
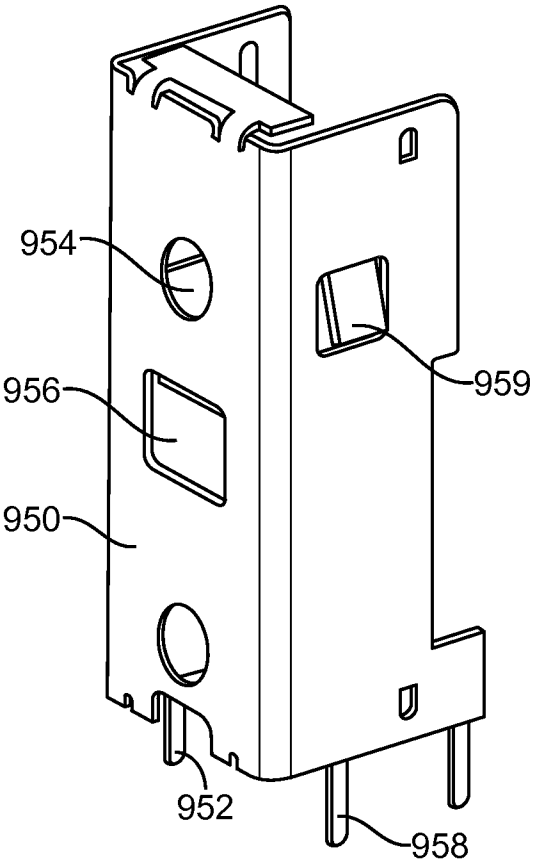

FIG. 13 illustrates a more detailed view of shield portions 940 and 950. Again, shield portion 950 may fit around a back of registration piece 916. Tabs 942 may be inserted through slots into grooves on registration piece 916. Shield portion 950 may include tabs 956 and 959, and openings 954 and 952, as discussed above. Tabs 958 may be inserted into openings on a printed circuit board. These openings on the print circuit board may be connected to traces or planes connected to ground or other appropriate potential.

Figure 14:
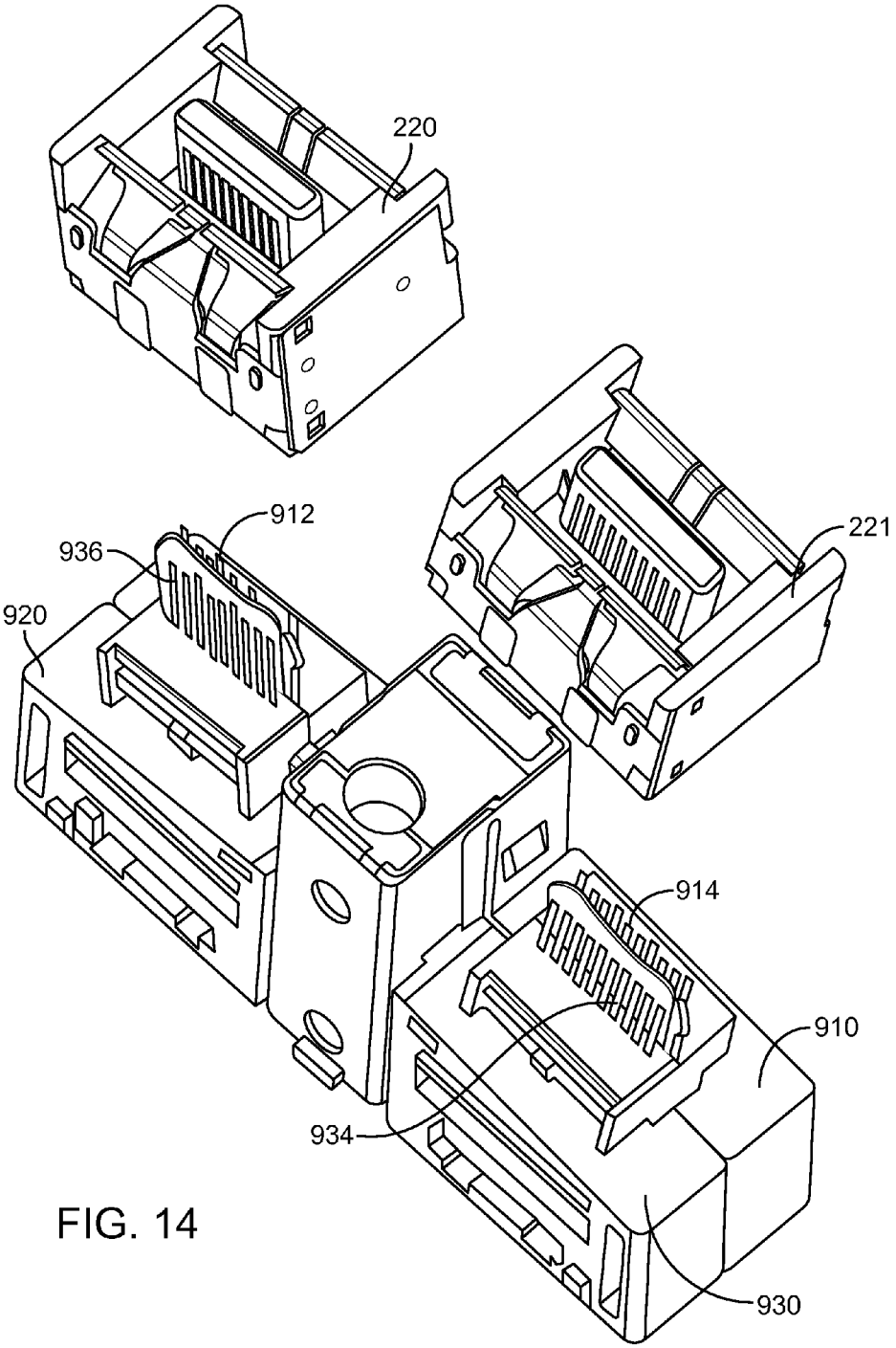
FIG. 14 illustrates components for a module in a connector assembly according to an embodiment of the present invention.

FIG. 14 illustrates components for a module in a connector assembly according to an embodiment of the present invention. FIG. 14 illustrates connector receptacles 220 and 221, which may be placed over top portions of main insert mold 910, second insert mold 920, third insert mold 930, and pins 912, 914, 934, and 936. In various embodiments of the present invention, connector receptacles 220 and 221 may be the same in order to simplify manufacturing.

As outlined above, embodiments of the present invention may provide a connector assembly having a number of modules 210 each having a number of connector receptacles 220 and 221. Connector receptacles 220 and 221 within a module 210 may be accurately positioned relative to each other by mounting them on a common main insert mold 910. Connector receptacles 220 and 221 among modules 210, 211, and 212, may be accurately positioned relative to each other in a first and second direction (in a plane of a backside of module 210) by using alignment pins 710 that may be inserted through the modules 210, 211, and 212, and in a third direction (along a length of alignment pins 710) by registration features such as lips 622 or standoffs 918 on front and back sides of the main insert mold 910 in each module 210, 211, and 212. Through-hole contacting portions for pins in these connectors may be accurately positioned relative to each other by forming insert molds 910, 930, and 932 around the pins and using alignment features, such as posts 913 and alignment feature 911, to position molds 910, 930, and 932, and their pins relative to each other in a module 210. Through-hole portions of pins, and tabs for shields, among modules may be positioned relative to each other by the use of alignment pins 710 and registration features, such as lips 622 or standoffs 918.

Figure 15:
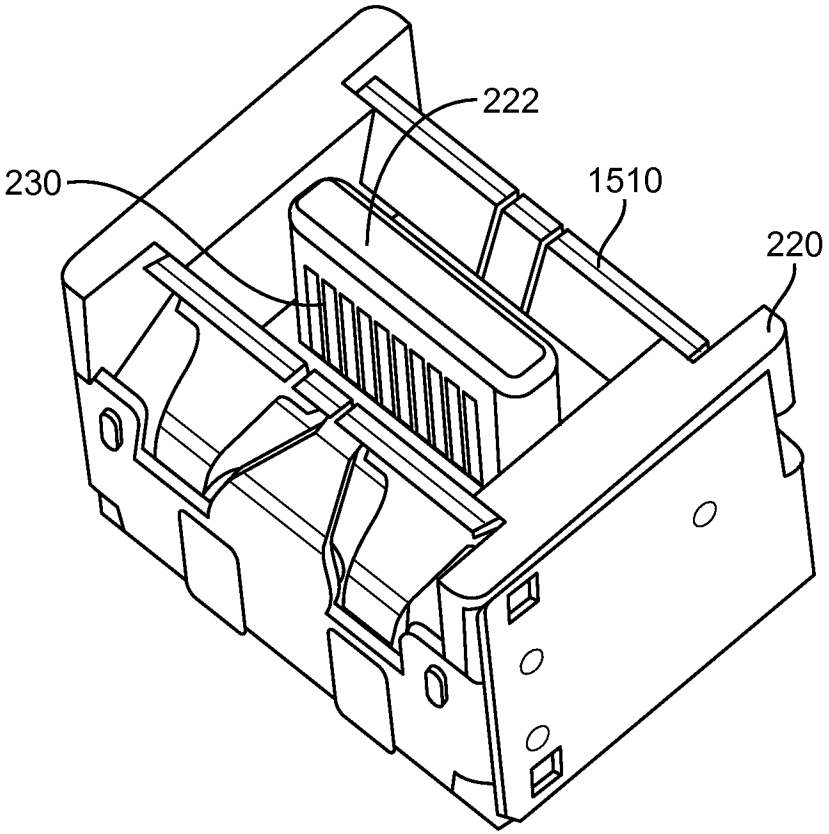
FIG. 15 illustrates a connector receptacle according to an embodiment of the present invention.

FIG. 15 illustrates a connector receptacle according to an embodiment of the present invention. Connector receptacle 220 may include ground shield 1510. As before, receptacle 220 may include tongues 222 supporting a number of contacts 230.

Figure 16:
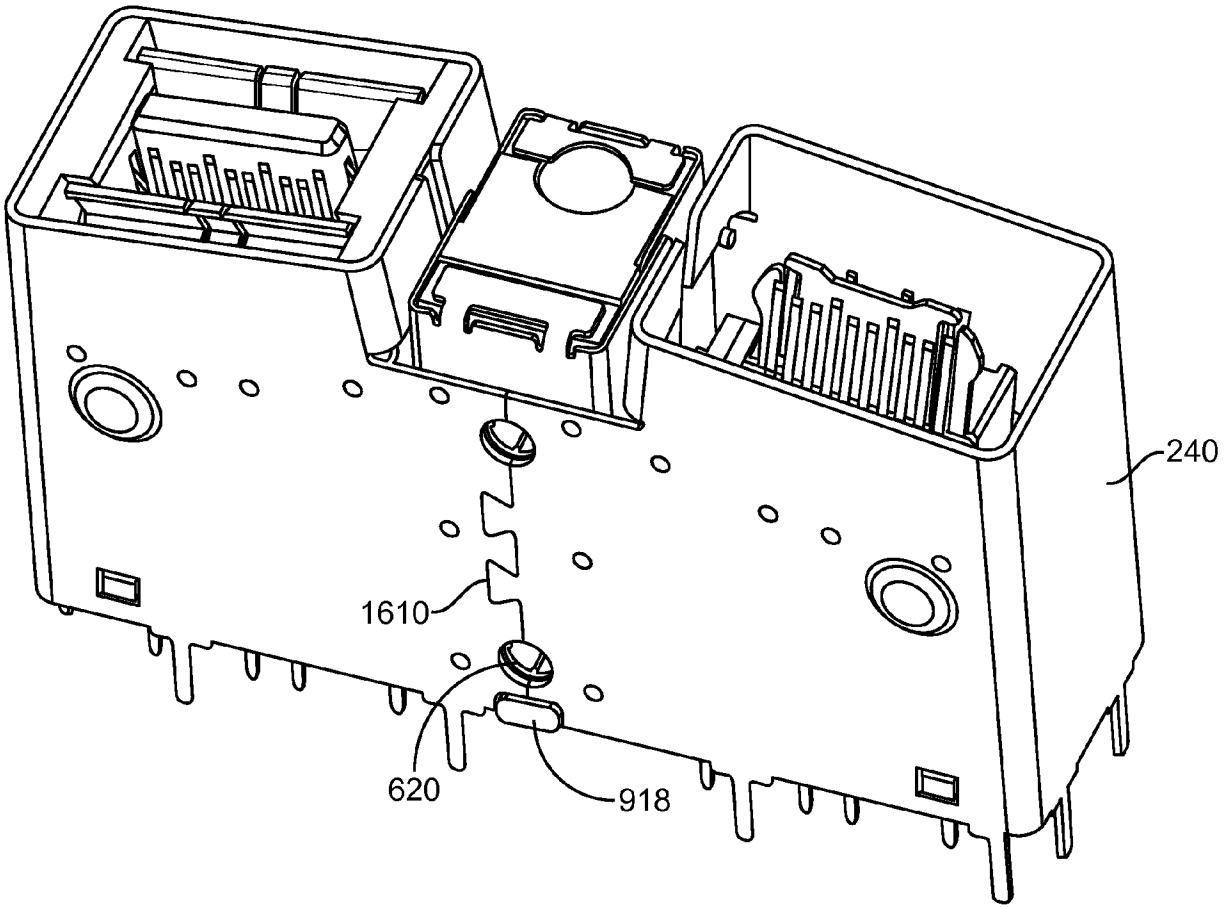
FIG. 16 illustrates portions of a module according to an embodiment of the present invention.

FIG. 16 illustrates portions of a module according to an embodiment of the present invention. Standoff 918 may extend beyond shield 240 such that it may contact a corresponding standoff on a second module. Since standoff 918 is used, there is no lip 622 around passage 620 in this example, though in other embodiments of the present invention, one may be included. Seam 271, as shown in FIG. 2, may be absent and may be replaced by seam 1610. Seam 1610 may be located between two modules where it will not be visible when a complete connector assembly 112 is assembled.

Embodiments of the present invention may support various high-speed signaling interfaces. One such device may be the Thunderbolt interface. Thunderbolt interfaces may include a number of differential pairs of signals having ground or power supply lines on each side. Surrounding these high-speed differential pairs with grounds or power supplies helps shield the signals on the differential pairs from each other.

Figure 17:
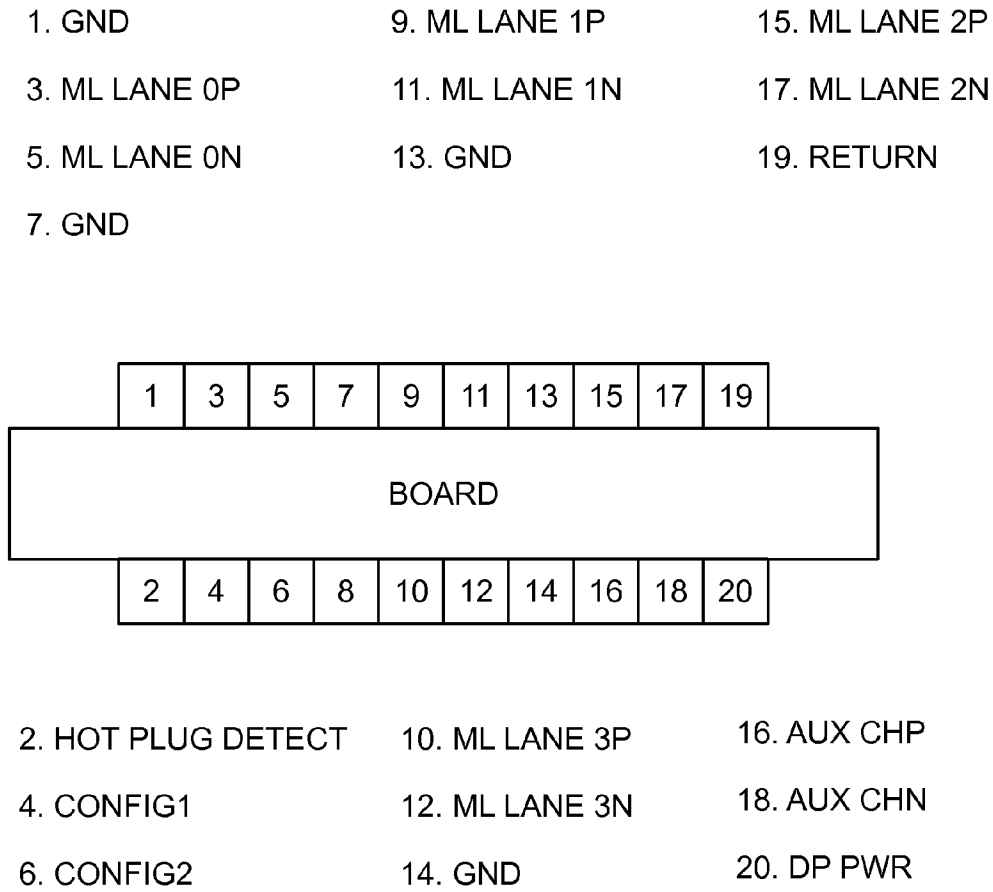
FIG. 17 is a pinout for a Thunderbolt connector.
Figure 18:
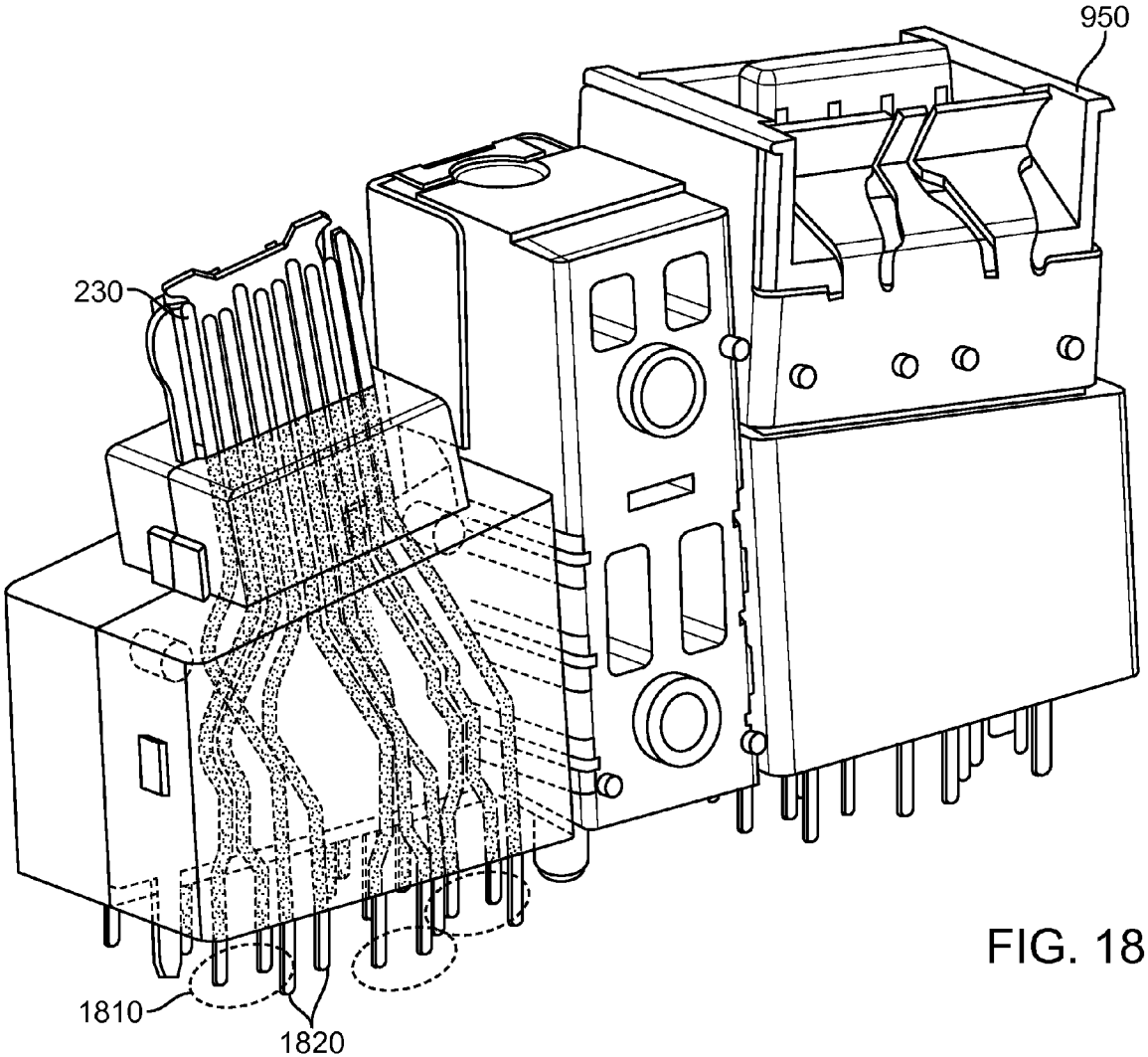
FIG. 18 illustrates a routing of pins through a module of a connector assembly according to an embodiment of the present invention.

FIG. 17 is a pinout for a Thunderbolt connector illustrating this arrangement. Again, while embodiments of the present invention are well-suited to providing a number of Thunderbolt connector receptacles, other embodiments of the present invention may provide a number of connector receptacles such as those compatible with MagSafe, DisplayPort, the various Universal Serial Bus interfaces and standards, including USB, USB2, and USB3, as well as HDMI, DVI, power, Ethernet, and other types of interfaces and standards FIG. 18 illustrates a routing of pins through a module of a connector assembly according to an embodiment of the present invention. In this example, differential pairs 1810 may be isolated from each other by ground or power supply pins 1820. Ground or power supply pin 1020 may also be other low-impedance, non-transitory or low-frequency pins.

Figure 19:
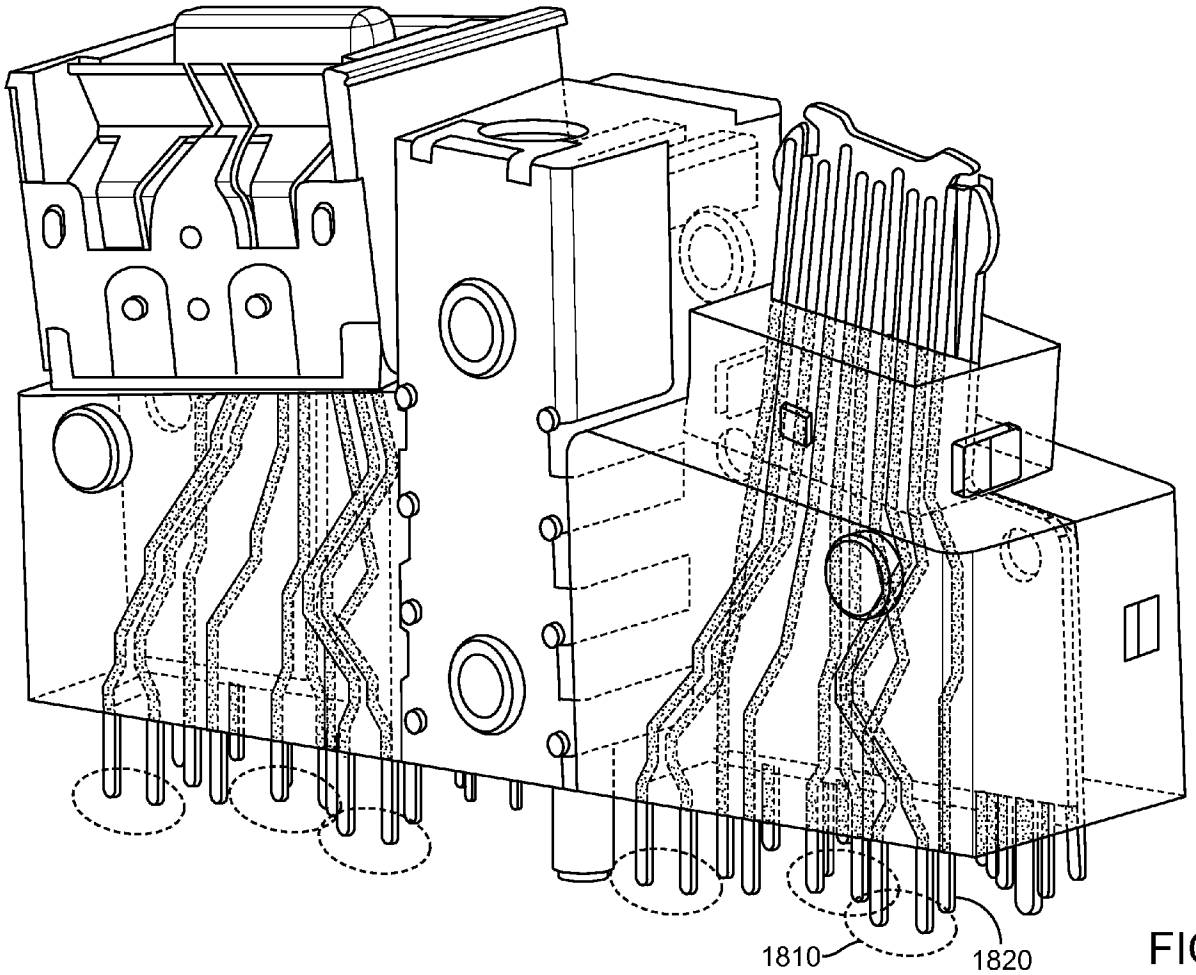
FIG. 19 illustrates a routing of pins through a module of a connector assembly according to an embodiment of the present invention.

FIG. 19 illustrates a routing of pins through a module of a connector assembly according to an embodiment of the present invention. Again, pins 1820 may be power or low frequency pins and may be used to isolate differential pair signals on pins 1810.

Figure 20:
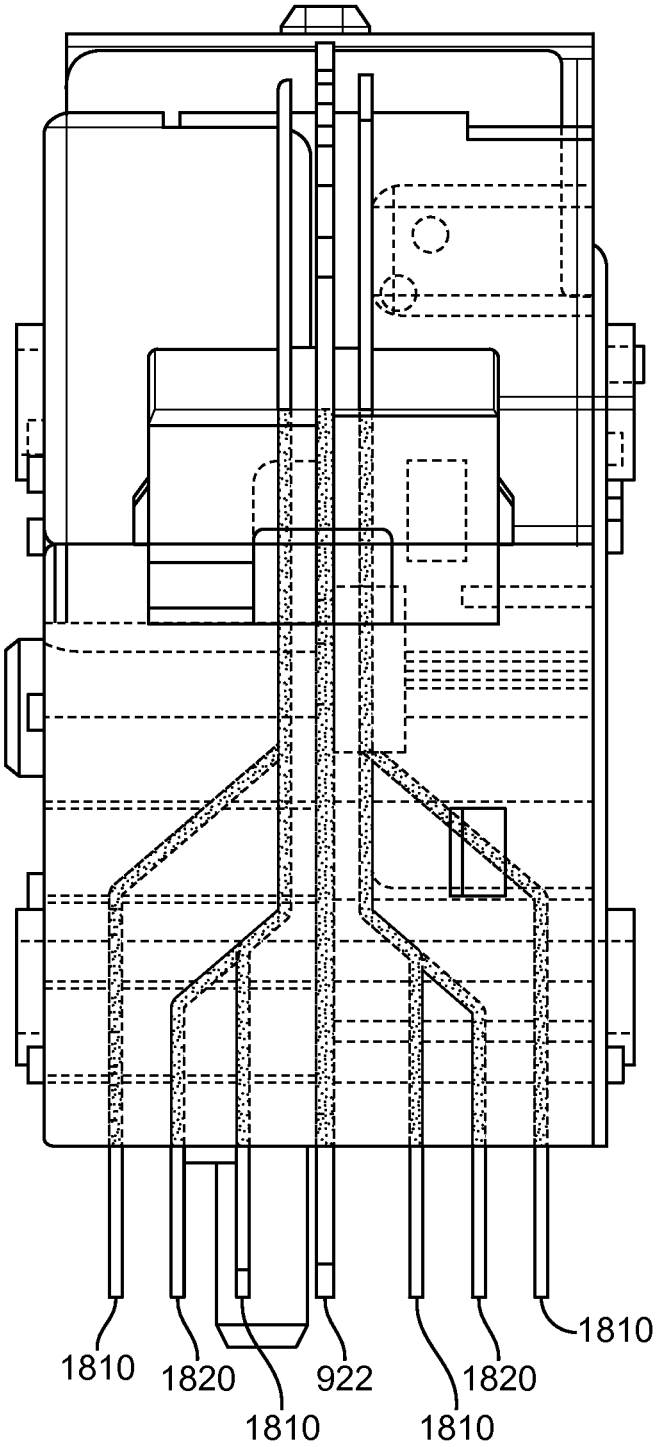
FIG. 20 illustrates a side view of a module.

This isolation may be both in lateral and depth dimensions. FIG. 20 illustrates a side view of a module showing differential pairs 1810 isolated from each other by intermediately located pins 1820. Ground tabs 922 may provide further isolation for differential pairs 1810 on the front and back sides of a module.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector assembly comprising:

a plurality of modules, each module comprising:

a first plurality of contacts;

a second plurality of contacts;

a main insert mold having a left portion formed around the first plurality of contacts and a right portion formed around the second plurality of contacts, the main insert mold further comprising a registration piece between the left portion of the main insert mold and the right portion of the main insert mold;

a third plurality of contacts;

a second insert mold around the third plurality of contacts;

a fourth plurality of contacts;

a third insert mold around the fourth plurality of contacts;

a first ground plane positioned between the left side of the main insert mold and the second insert mold;

a second ground plane positioned between the right side of the main insert mold and the third insert mold;

a first connector receptacle engaged over a top of the left portion of the main insert mold, the first ground plane, and the second insert mold; and a second connector receptacle engaged over a top of the right portion of the main insert mold, the second ground plane, and the third insert mold; and a first alignment pin passing through a first passage of each of the plurality of modules to align each of the plurality of modules to each other.

2. The connector assembly of claim 1 wherein the first alignment pin is located in a passage in each registration piece in each of the plurality of modules in the connector assembly.

3. The connector assembly of claim 2 further comprising an alignment post to align the connector assembly to a device enclosure for an electronic device housing the connector assembly.

4. The connector assembly of claim 3 wherein each of the plurality of modules further comprises a shield.

5. The connector assembly of claim 4 further comprising a shield portion attached to at least a shield of a first module and a shield of a second module in the plurality of modules to secure the plurality of modules to each other.

6. A connector assembly comprising:

a plurality of modules, each module comprising:

a plurality of connector receptacles, each of the connector receptacles having a plurality of contacts and a face, the faces of at least two of the plurality of connector receptacles at an oblique angle to each other;

a registration piece connected between two of the connector receptacles and having a first passage forming openings on a top and bottom of the registration piece; and a shield around the plurality of connector receptacles and the registration piece;

a first alignment pin passing through the first passage of each of the plurality of modules to align each of the plurality of modules to each other; and a shield portion to secure the plurality of modules to each other.

7. The connector assembly of claim 6 wherein the plurality of connector receptacles for each module comprises two connector receptacles.

8. The connector assembly of claim 7 further comprising an alignment post to align the connector assembly to a device enclosure for an electronic device housing the connector assembly.

9. The connector assembly of claim 8 wherein the electronic device is a computer.

10. The connector assembly of claim 8 wherein each of the connector receptacles are Thunderbolt connector receptacles.

11. The connector assembly of claim 6 wherein in each registration piece comprises a second passage, and the connector assembly further comprises a second alignment pin passing through the second passage of each of the plurality of modules to align each of the plurality of modules to each other.

12. The connector assembly of claim 6 wherein each registration piece includes a standoff, where standoffs of adjoining modules are in contact.

13. A connector assembly comprising:

a plurality of modules including a first module and a second module, each module at least partially surrounded by a shield and including a first passage, the first passage forming openings in a top and bottom of the module;

a shield portion attached to the shield of the first module and the second module to attach the plurality of modules to each other; and a first alignment pin located through the first passage in each of the plurality of modules, wherein each of the plurality of modules comprises:

a first connector receptacle having a first plurality of contacts;

a second connector receptacle having a second plurality of contacts; and a first registration piece between and connected to the first connector receptacle and the second connector receptacle.

14. The connector assembly of claim 13 further comprising:

an alignment post partially inserted in an opening in one of the plurality of modules.

15. The connector assembly of claim 14, wherein each module further comprises a second passage, the connector assembly further comprising:

a second alignment pin located through the second passage in each of the plurality of modules.

16. The connector assembly of claim 13 wherein the first registration piece comprises a standoff, and the standoff of the first registration piece in the first module is in contact with a standoff in a first registration piece in the second module.

* * * * *